US005694706A

United States Patent [19]

Penka

[11] Patent Number: 5,694,706

[45] Date of Patent: Dec. 9, 1997

[54] HEELLESS ATHLETIC SHOE

[76] Inventor: Etienne Penka, 18 Glencoe St. #41, Brighton, Mass. 02135

[21] Appl. No.: 703,071

[22] Filed: Aug. 26, 1996

[51] Int. Cl.[6] ..... A43B 13/14

[52] U.S. Cl. ..... 36/103; 36/129; 36/132; 36/25 R

[58] Field of Search ..... 36/102, 103, 105, 36/25 R, 106, 129, 132, 30 R, 80

[56] References Cited

U.S. PATENT DOCUMENTS

| | | | |
|---|---|---|---|
| Re. 34,102 | 10/1992 | Cole et al. | 36/28 |
| 2,095,766 | 12/1937 | Shapiro | 36/2.5 |
| 2,460,493 | 2/1949 | Diamant | 36/80 X |
| 2,758,394 | 7/1956 | Whitlock | 36/2.5 |
| 3,028,689 | 4/1962 | Dassler | 36/2.5 |
| 3,475,837 | 11/1969 | Garcia | 36/24.5 |
| 3,918,181 | 11/1975 | Inohara | 36/2.5 |
| 4,040,192 | 8/1977 | Perez | 36/129 X |
| 4,041,619 | 8/1977 | Sapper | 36/103 X |
| 4,130,947 | 12/1978 | Denu | 36/30 R |
| 4,187,623 | 2/1980 | Dassler | 36/129 |
| 4,212,120 | 7/1980 | Bowerman et al. | 36/129 |
| 4,263,728 | 4/1981 | Frecentese | 36/129 |
| 4,348,821 | 9/1982 | Daswick | 36/103 |
| 4,361,971 | 12/1982 | Bowerman | 36/129 |
| 4,372,059 | 2/1983 | Ambrose | 36/103 X |
| 4,378,643 | 4/1983 | Johnson | 36/129 |
| 4,399,620 | 8/1983 | Funck | 36/30 R |
| 4,404,759 | 9/1983 | Dassler | 36/129 |
| 4,446,633 | 5/1984 | Scheinhaus et al. | 36/30 R X |
| 4,562,651 | 1/1986 | Frederick et al. | 36/102 |
| 4,741,114 | 5/1988 | Stubblefield | 36/30 R X |
| 4,831,750 | 5/1989 | Muller | 36/30 R X |
| 4,924,606 | 5/1990 | Montgomery et al. | 36/31 |
| 4,949,476 | 8/1990 | Anderie | 36/129 |
| 5,138,776 | 8/1992 | Levin | 36/38 |
| 5,469,642 | 11/1995 | Farbman | 36/103 |
| 5,507,106 | 4/1996 | Fox | 36/103 |

FOREIGN PATENT DOCUMENTS

| | | | |
|---|---|---|---|
| 794454 | 2/1936 | France | 36/80 |
| 8108411 | 10/1981 | France . | |
| 1014462 | 8/1957 | Germany . | |
| 2720849 | 11/1978 | Germany . | |
| 2805426 | 8/1979 | Germany . | |
| 3115488 | 2/1982 | Germany . | |
| 9111124 | 8/1991 | WIPO . | |

*Primary Examiner*—Ted Kavanaugh
*Attorney, Agent, or Firm*—Pearson & Pearson

[57] ABSTRACT

A shoe comprising an upper and multiple part sole. An inner sole engages the plantar surface of a foot. A shock absorbing midsole underlies the inner sole from a location underlying the toes to a location at the base of a heel of the foot. An outer sole includes a first portion under the forefoot to provide a second shock absorbing layer and to define a landing surface. A thin, relatively rigid portion underlies the heel and corresponding portion of the inner sole to support the heel. This portion is elevated above the landing surface to inhibit heel landings and strikes.

36 Claims, 4 Drawing Sheets

HEELLESS ATHLETIC SHOE

BACKGROUND OF THE INVENTION

1. Field of the Invention

This invention relates to shoes and more particularly to shoes for use in various athletic endeavors such as walking, jogging and running.

2. Description of Related Art

Shoes suited for physical activities such as running, jogging, brisk walking, aerobic exercise and the like which involve stepping and landing on an individual's feet are well known. Generally these activities are characterized by suspension and landing of the foot. In such physical activities the individual's foot acts as a shock absorber upon landing, a support member during the period between landing and stepping off, and a spring for propelling, launching or stepping from the surface such as the ground. Despite many advances in the design and construction of athletic shoes, injuries incurred during such activities continue to be wide spread. Such injuries include heel spurs, plantar fascia, shin splints, and stress fractures of the sesamoid bones and head of the metatarsal bones, as well as metatarsalgia. Other musculoskeletal injuries that can result from these physical activities include posterior compartment syndromes, calf reaction syndrome, and various knee, hip, back and scapula problems. Frequently it is the way an individual lands and then steps off that leads to these injuries. In many cases inadequacies of the shoes worn by the individual are a significant contributing factor.

The vast majority of walkers, runners and joggers and the like land heel first on the ground and then push off with the forefoot. However, during a heel landing the Tibialis Anterior, Extensor Digitorum Longus, Extensor Halluces, and Peroneus Tertius place the foot in dorsiflexion. This foot position minimizes the natural shock absorbing capacity of the foot and often leads to the previously discussed injuries.

Forefoot landings, as opposed to heel landings, have been proven to be the most efficient landing pattern during physical activities that involve such stepping off and landing. During forefoot landings, the landing forces are applied generally to the dynamic front part of the foot, or forefoot, comprising the toes and the ball of the foot simultaneously. The intrinsic muscles of the foot and the skeletal structure including the gastrocnemius, Soleus, Plantaris, Tibialis Posterior, Flexor Digitorum, Flexor Halluces, Peroneus Longus and Brevis place the arch of the foot in a proper attitude to act as a shock absorbing spring as the forefoot impacts a support surface. Moreover, stepping off from the forefoot without initial heel contact tends to increase efficiency as there is no effort expended to rotate the foot from the heel to the toe. Forefoot landings also reduce the strain on the musculoskeletal structure. However, individuals also must consciously attempt to land on the forefoot. Frequently they revert to a heel landing when they become fatigued or otherwise distracted or preoccupied.

To overcome the injuries associated with heel landings, makers of various types of athletic shoes generally pad the heel to provide some shock absorption. While such padding does reduce shock somewhat, the impact to the heel can still be in the range of three or more times the individual's weight during jogging. Consequently, even highly padded heels do not provide a sufficient absorption to reduce the number of injuries to individuals. That is, reasonable levels of padding can not substitute for the shock absorbing system in an individual's forefoot.

Other suggested shoe constructions for athletic shoes involving landing and stepping off are disclosed, for example, German Patent Nos. 1,014,462 and 2,805,426 to Adolph Dassler. These patents disclose running shoes with and without raised heel portions. These running shoes include spikes projecting from the portion underlying the forefoot with the sole extending distally under the heel. Similar shoes with raised heels are disclosed by Armin Dassler in U.S. Pat. Nos. 3,028,689 and 4,187,623. Likewise U.S. Pat. Nos. 4,212,120 and 4,361,971 to Bowerman et al. and Bowerman respectively disclose shoes with a portion underlying the heel that is level with the portion underlying the ball or forefoot of the foot. Although these shoes could encourage an individual to use a forefoot landing, nothing in the construction inherently prevents heel landings.

U.S. Pat. Nos. 4,924,606 and 5,469,642 to Montgomery et al. and Farbman, respectively disclose other prior art shoes with relatively flat soles extending distally from the ball of the foot to the heel. Still other prior art shoes as disclosed by U.S. Pat. No. 4,404,759 to Armin Dassler incorporate a sole with low-height cleats extending over the sole except for a portion under the heel. The cleats absorb shock. U.S. Pat. Nos. 4,263,728 and 3,918,181 to Frecantese and Inohara, respectively, disclose cleats underlying substantially all of the bottom surface of the shoe. In the Frecantese patent, pumping pegs compress air in a cavity under the sole to distribute forces. The Inohara patent discloses cleats and recesses improving traction.

U.S. Pat. No. 2,758,394 to Whitlock and U.S. Pat. No. 4,949,476 to Anderie disclose running shoes with projecting spikes underlying the portion of the foot including the toes and ball of the foot. The heel portion of these running shoes is raised relative to the portion with the extending spikes.

Nevertheless each of these patents disclose a striking surface provided under the heel to account for heel strikes. In the Anderie patent, a recessed heel surface, relative to the ball portion of the foot, underlies portions of the forefoot as well as the heel. In another embodiment of the Anderie patent and in the Whitlock patent the heel recess extends from the rear of the shoe to a point intermediate the heel and the ball of the foot. Consequently, it becomes quite easy for the heel to strike the ground before the forefoot during a normal walking, jogging or running motion.

Several of these references and others increase padding in the shoe to underlie the heel to reduce the shock to the heel. In fact, U.S. Pat. No. 5,138,776 to Levine discloses a shoe that attempts to provide both greater shock absorption and lifting force by providing a spring member in the heel. Still others have attempted to provide a thrust producing portion of a shoe in both a heel and forefoot portion, for example as disclosed by Cole et al. in U.S. Reissue Pat. No. Re. 34,102.

None of these references disclose a shoe which effectively inhibits an individual from adopting a heel landing technique for running, jogging or walking or other activities involving suspension and landing. Consequently individuals by lack of knowledge, fatigue or other factors, continue to use the heel landing techniques. The various efforts to compensate for this tendency, as described above that add padding or spring members in the heel portion of the shoe and or even to encourage a forefoot landing pattern have not been entirely successful. None of these approaches eliminates the severity of the strain to the body resulting from heel landings. The shoes that have attempted to encourage a forefoot landing have also failed to effectively inhibit heel landing patterns that a wearer frequently adopts through lack of attention or fatigue. Likewise these references do not disclose or suggest an athletic shoe that tends to reduce the flexure of the foot that occurs between a heel landing and stepping off generally associated with the shoes of the prior art.

SUMMARY

Therefore, it is an object of this invention to provide a shoe for enhancing forefoot landing during physical activities.

It is another object of this invention to provide a running shoe that inhibits heel landings during physical activities.

It is still another object of this invention to provide an athletic shoe that can enhance an individual's performance and does not cause the foot to undergo unnecessary and potentially dangerous dorsiflexion from the step off to the pre-landing phase.

It is yet another object of this invention to provide a shoe that is adapted for use during rehabilitation from injuries caused by heel-to-toe landing patterns.

It is a further object of this invention to provide a shoe for encouraging pre-disposition of the foot for landing on and immediate stepping off from the forefoot.

It is yet still another object of this invention to provide a shoe that does not place undue tension of the Gastrocnemius-Soleus muscle and the Achilles tendon.

A shoe constructed in accordance with this invention has an upper and a multiple part sole forming an interior volume for receiving an individual's foot. The sole comprises an inner sole, a midsole and an outer sole. The inner sole engages the planter surface of the foot. The midsole attaches to the exterior of the inner sole to be coextensive with at least a portion of the forefoot. The outer sole has a first portion of variable thickness for underlying at least a portion of the forefoot and a second contiguous portion for underlying the heel. The first portion provides a landing surface for the shoe. The second portion is thinner than the first whereby an exterior surface of the second portion is elevated relative to the landing surface thereby to prevent heel landings.

BRIEF DESCRIPTION OF THE DRAWINGS

It is intended that the appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
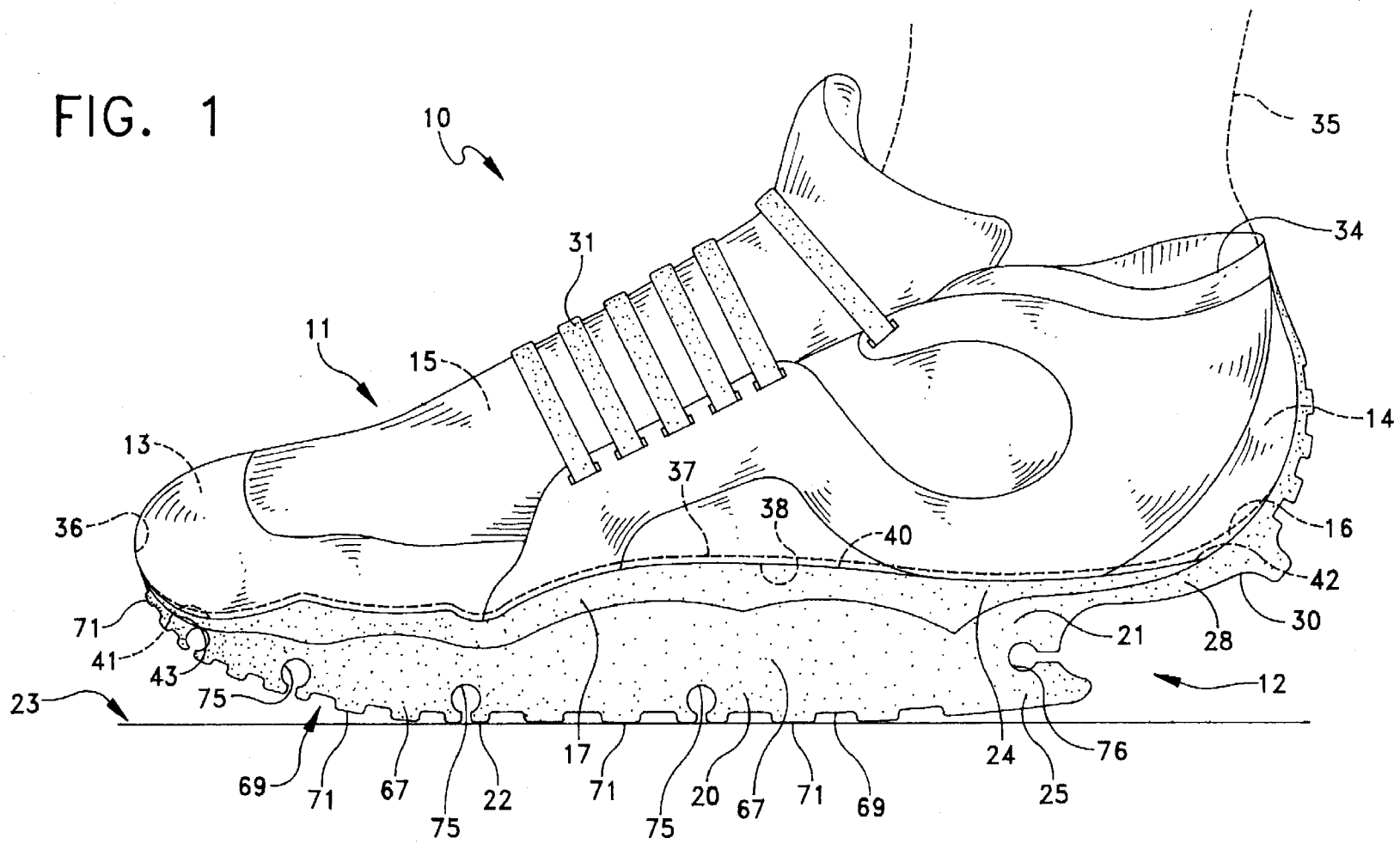
FIG. 1 is a side elevation of a shoe in accordance with this invention.

As shown in FIG. 1 a shoe 10 according to this invention includes an upper 11 attached to a multiple part sole 12 to define a volume for receiving an individual's foot with a toe box 13, a heel box 14, and an intermediate section 15. The multiple part sole 12 comprises an inner sole means comprising an inner sole 16, a midsole means comprising a midsole 17 and an outer sole means comprising an outer sole 20. A first portion 21 of the outer sole 20 defines a landing surface 22 for engaging a support surface 23 formed by the ground, floor or the like. Rearward end 24 of the midsole 17 and rearward end 25 of the outer sole 20 and the first portion 21, respectively, underlie a portion of the intermediate section 15 proximate the heel box 14. At this position, each has a relatively substantial thickness in a direction parallel to a vertical axis 26 and perpendicular to a longitudinal axis 27. A relatively thin rear or second portion 28 of the outer sole 20 extends from the rearward end 25 to underlie the heel box 14 and define an exposed recessed surface 30 that is elevated from the support surface when the shoe 10 is in a normal resting position as shown in FIG. 1. This construction in combination with the mechanics of the ankle and foot prevent heel contact before the landing surface 22 contacts the support surface 23.

The upper 11 as depicted in FIG. 1 may have any conventional construction depending upon seasonal factors, foot conditions and other criteria that are not pertinent to this invention. In the specific embodiment of FIG. 1, the upper 11 comprises a substantially standard upper with laces 31 for securing the shoe 10 on an individual's foot 32. The upper 11 defines an access aperture 34 through which the individual's ankle 35 extends. Materials for forming the upper 11 can include, for example, canvas, leather or plastic materials. It will also be appreciated that although the shoe 10 is depicted as a low-top tie shoe, which is the preferred embodiment, the upper can also be made in a mid-top or high-top arrangement. Velcro® strips or other tying arrangements can be substituted for the laces. The shoe could even be constructed as a loafer with no tying arrangement.

Figure 2:
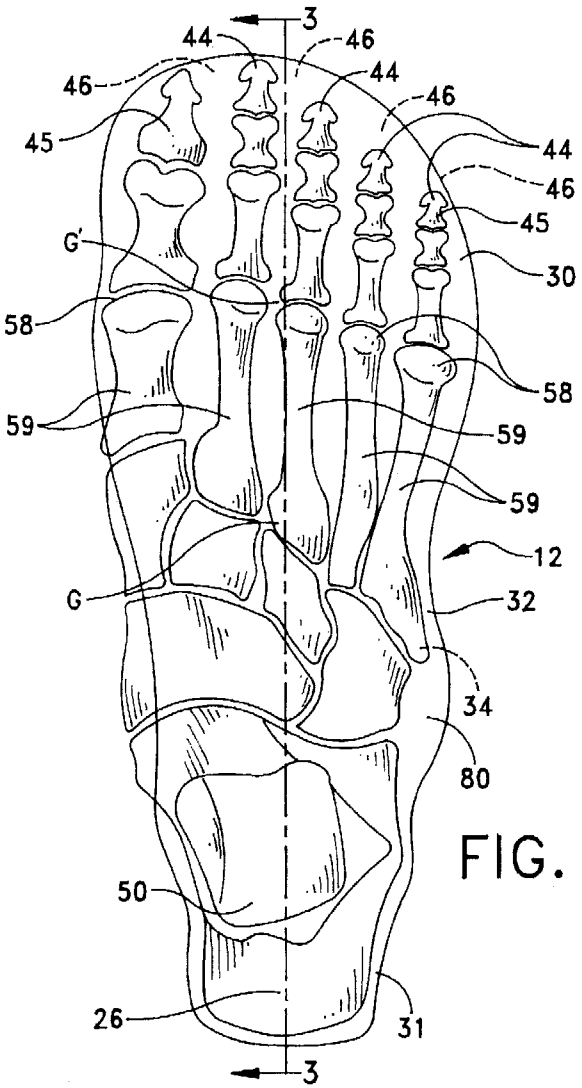
FIG. 2 is a top view of the shoe of FIG. 1 with an upper removed.
Figure 3:
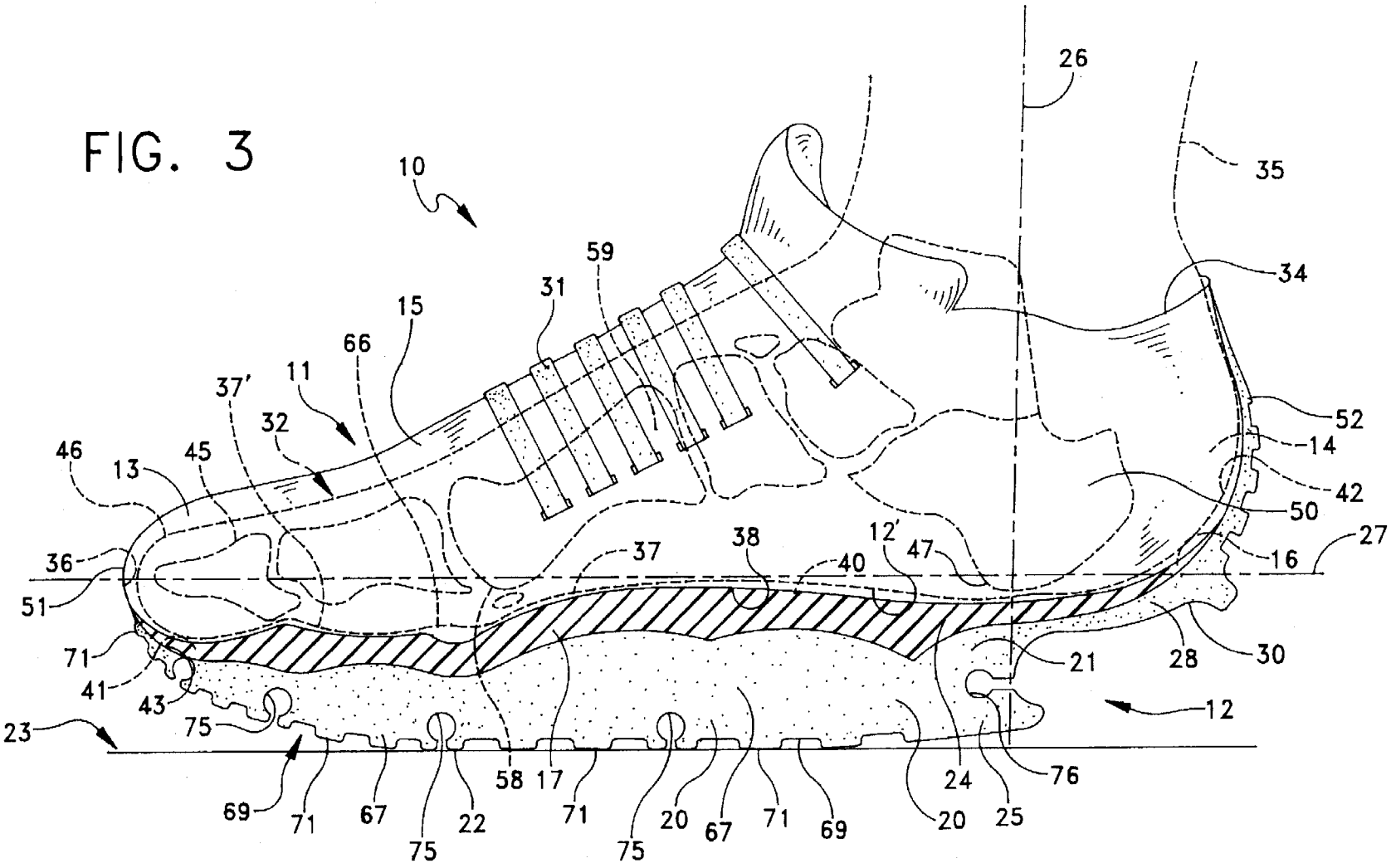
FIG. 3 is a cross sectional view taken along lines 3—3 in FIG. 2.

With reference to FIGS. 2 and 3, the inner sole 16 extends from a front or toe end 36 of the toe box 13 through the heel box 14 and has an upper or inner surface 37 and a lower or outer surface 38. The upper surface 37 engages a plantar surface 39 of the foot 32; the lower surface 38 abuts an upper surface 40 of the midsole 17. Upper heel surface portion of the outer sole 20 extends back beyond the midsole 17.

The inner sole 16 preferably comprises a thin layer of relatively soft material that resiliently deforms to correspond to both the shapes of the overlying plantar surface 39 and the underlying surface 40 and surface portions 41 and 42. A soft thin foam having an open cell construction is an example of such a material.

With reference to FIG. 3, the midsole 17 preferably comprises a material that is relatively hard with some elasticity such as various natural and synthetic cellular foam materials with small apertures or like. A closed cell, elastic, pressure deformable foam is an example of such a material.

The midsole 17 underlies a portion of the toe box 13 and the intermediate section 15, preferably from a front end 43 proximate the proximal bases 44 of the distal phalanges 45 to the rearward end 24 underlying an area corresponding to the calcaneum bone 50. The overall vertical thickness of the midsole 17 essentially increases from the front end 43 to the rearward end.

With continuing reference to FIG. 3, the outer sole 20 underlies the entirety of the shoe 10 and may even wrap around leading and trailing ends 51 and 52 of the upper 11. The second portion 28 is preferably thin compared to the combined thicknesses of the rearward ends 24 and 25. The recessed surface 30 thus remains substantially spaced from the support surface 23 upon initial contact by the landing surface 22 during walking, running, jogging or other similar activities. Further, the second portion 28 is preferably formed of a substantially rigid, hard material such as known non-elastic rubber or various plastic compounds that tend not to deflect under the pressure loads associated with use of the shoe 10. Consequently, the second portion 28 firmly supports an individual's heel 46 through the inner sole 16 while maintaining the spacing from the support surface 23. The first portion 21 including the landing surface 22 is preferably formed of a softer, more flexible or elastic material, such as other known rubber or plastic compounds to provide more cushioning while also providing support and durability during use.

The spacing of the second portion 28 above a support surface will be based upon a number of considerations. These include the normal range of foot movement, typically 20° in dorsiflexion, shoe size, anticipated body weight and proficiency or anticipated speed of prospective users. A spacing between 1 cm. and 3 cm. is appropriate for an average shoe and application. The spacing would be increased for smaller shoe sizes, lighter runners and slower runners.

Figure 4:
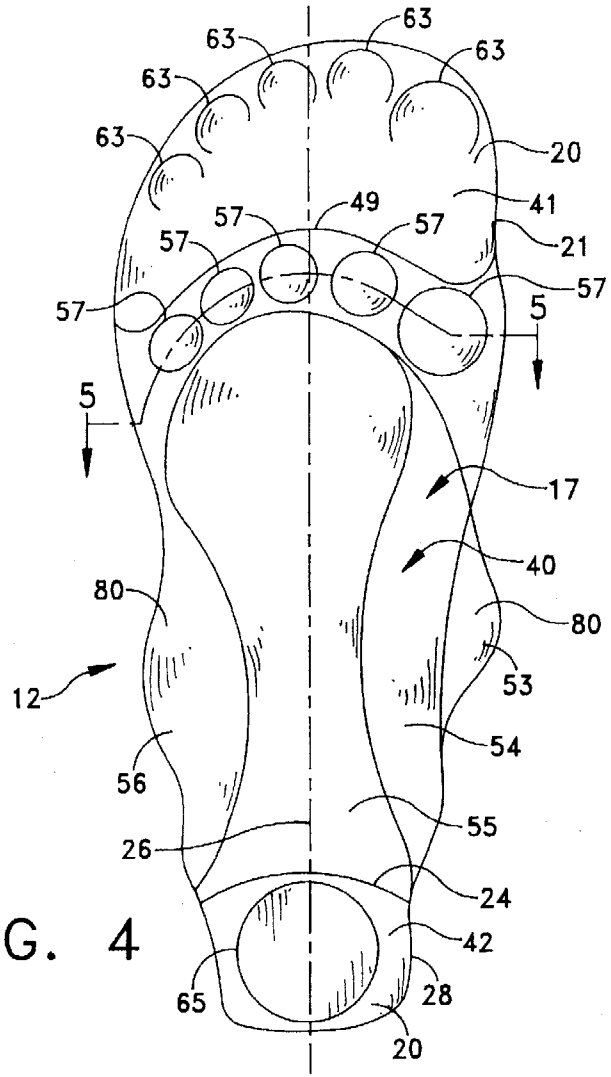
FIG. 4 is a top view similar to FIG. 2 with an inner sole removed.

The multiple part sole 12 includes additional features for increasing the comfort and utility of the shoe 10. First, the upper surfaces 40 of the midsole 17, as depicted in FIG. 4, preferably include a plurality of extending and recessed surface features to provide additional support for various skeletal structures of the foot 32. Longitudinally extending members 53, 54, 55, and 56 provide longitudinal arch support. The longitudinal member 54 extends from the apex of the calcaneum bone to proximate a distal end of the phalange of the big toe. It is higher than the other longitudinal members 53, 55, and 56. The longitudinal member 54 tends to prevent the downward migration of navicular and cuneiform bones while limiting tension forces on the plantar and also providing improved gripping action by the toes. The longitudinal member 55 extends from the apex of the calcaneum bone to the distal end of fifth toe tends to prevent abnormal downward displacement of the cuboid bone while supporting the base of the styloid process of the fifth metatarsal bone. A plurality of annular extensions 57 register with distal heads 58 of the metatarsal bones 59 shown in FIGS. 2 and 3. The extending members 53, 54, 55 and 56 and the annular extensions 57 act on the plantar surface 29 through the thin and compliant inner sole 16.

The upper surface portion 41 of the inner sole 15, as seen in FIG. 4, includes a plurality of open, or C-shaped extensions 63 for positioning the toes 46 therein. These extensions 63 act to maintain toe spacing and provide additional support during the interval of increased force during landing and stepping off. This reduces the possibility of an individual's sustaining friction injuries such as blisters, calluses, bunionnettes and bunions. Moreover the level of padding under the toe box 13 coupled with the extensions 63 for maintaining toe spacing enhance the ability of the toes and corresponding musculoskeletal structures to absorb the shock associated with landing and stepping off on the forefoot.

The upper surface portion 42 underlying the heel box 14 includes a generally raised annular ring portion 65 in register with the base 47 of the calcaneum bone 50 (FIG. 4). This ring portion 65 provides increased support to and appropriate positioning for this portion of the foot 12 within the heel box 14. Thus the upper surface 37 of the inner sole 15 (FIGS. 1 and 4), due to its relative thinness and compliance, further conform the inner sole 15 to the plantar surface 39 with the midsole 17 providing the underlying support.

As depicted in FIGS. 1 through 4, the toe box 13 has a lateral width that is greater than the width of the heel box 14. Further, the toe box 13 and the intermediate section 15 lie above substantial padding provided by the midsole 17 and the outer sole 20. This locates the center of gravity, G, of the shoe 10 and a center of gravity G' of the shoe 10 when worn as depicted in FIGS. 2 and 3. The location of the center of gravity G' corresponds to the ball 66 of the foot at the tarso-metatarsal joints centered about the longitudinal axis 27. The forward location of the center of gravity G' promotes forefoot landings while the central or medial location of the center of gravity G' about the longitudinal axis 27 reduces the risk of inversion or eversion of the foot 12 during landing and stepping off.

Figure 5:
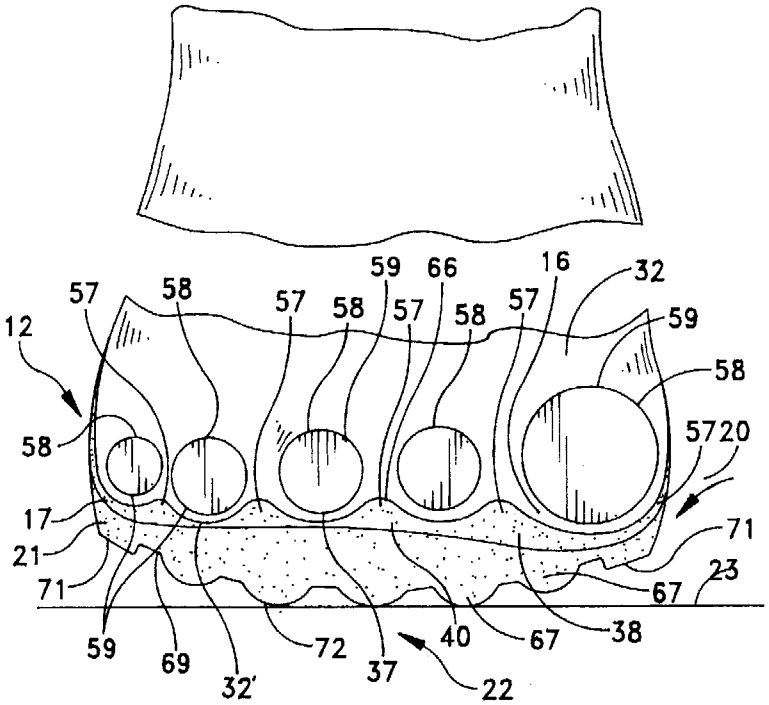
FIG. 5 is a cross sectional view taken along the section lines 5—5 of FIG. 4.

A lower portion 67 of the first portion 21 of the outer sole 20 including the landing surface 22, as seen in a cross-sectional view in FIG. 5, underlies the ball area 66 of the foot 12. This portion 67 has a convex shape in the transverse direction and, as seen in FIG. 1, a convex shape in the longitudinal direction. This double convex or spherical shape provides additional shock absorbing mechanism during landing. During landing the convex shape tends to flatten as depicted in FIGS. 1 and 5 absorbing energy. During stepping off, the other convex shape returns to its normal shape and transfers energy to the foot.

Figure 6:
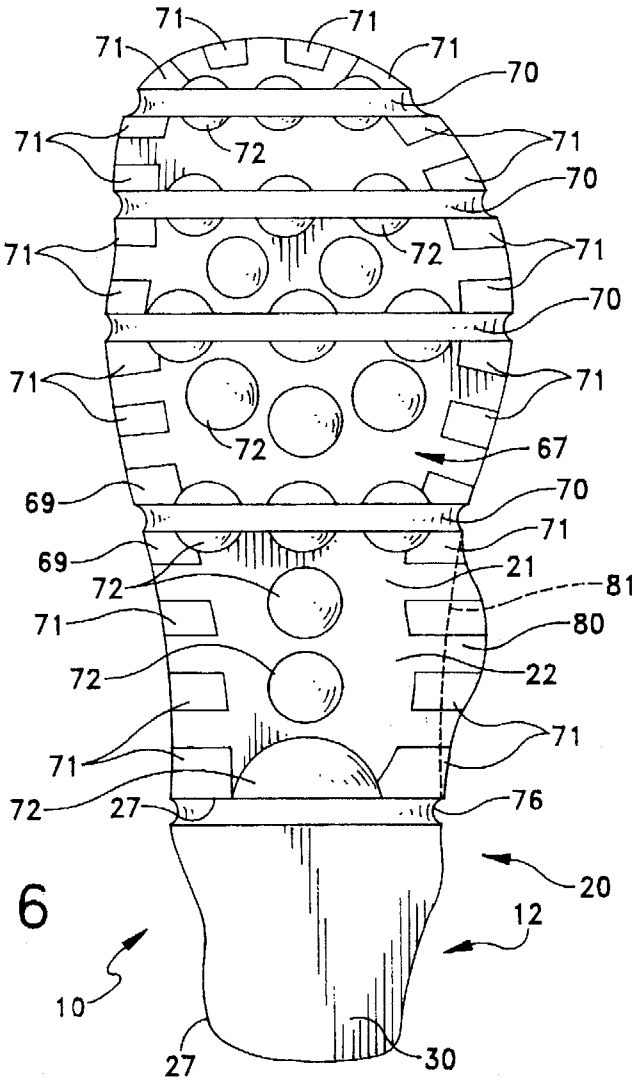
FIG. 6 is a bottom view of the shoe of FIG. 1.

As depicted in FIG. 6, a plurality of features extend from and into a generally smooth exterior or bottom surface 69 of the outer sole 20. These features enhance an individual's performance and reduce the stress applied to the foot and the rest of the individual's body. For example, a plurality of transverse channels 70 provide improved antero-posterior traction due to the pressure deformable material of which the first portion 20 is preferably made. A plurality of rectangular or polygonal extensions 71 are distributed about the periphery of the surface 69 to provide medio-lateral stability during both landing and stepping off. These extensions could also have a frusto pyramidal form.

Intermediate the rectangular prism-like members 71 a plurality of hemispherical projections 72 enhance the shock absorbing aspects of the outer sole 20 upon landing and provide additional spring force for stepping off. Applicant believes the hemispherical projections 72 also facilitate the proper timing of stepping off after landing because they tend to rebound from the force of landing and thereby urge substantially immediate stepping off after landing without the flexure normally associated with such contact.

As seen in FIGS. 1 and 3, the lower portion 67 also includes a plurality of flexible grips 75 at the ends of the channels 70 of FIG. 6. The grips 75 provide a convenient structure for energizing bungi cords or the like during preliminary and strengthening exercises. Additionally a rearmost transverse channel 76 may be provided with an auditory biofeedback device noise maker such as a spring steel clicker or other biped device to alert the user when the rear portion of the landing surface 22 contacts the support surface 23.

FIGS. 2, 4 and 6 depict lateral extensions 80 from the normal curvature of the outer sole 20. A dashed line 81 in FIG. 6 defines the normal edge of the sole 20. This extension 80 constitutes a support for the styloid process of the fifth metatarsal bone and prevents ankle inversion and resulting ankle sprains.

In summary, a shoe 10 constructed in accordance with this invention includes a proximal sole portion of a multiple part sole with a landing surface under the forefoot composed of a pressure deformable material. The landing surface underlies the toe box and intermediate section of the shoe. A rear portion of an outer sole underlies the heel box and is closely spaced to the foot to be elevated with respect to the landing surface. The combination of the foot and shoe have a center of gravity proximate the ball of the foot to promote forefoot landing. The shoe also incorporates structures for cushioning the landing and providing forward spring on stepping off. A plurality of structures underlie the skeletal structure of the foot to promote adequate support and positioning of the foot. Thus the invention as describe herein provides a shoe that reduces the risks of injury associated with prior art shoes, enables physical activities during rehabilitation from such injuries, and enhances the performance of users of such shoes.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by letters patent of the United States is:

1. A shoe having an upper, a toe portion and a rear portion and a multiple part sole forming an interior volume for receiving an individual's foot, the foot including a plantar surface, a forefoot, a toe a heel and a calcaneum, said multiple part sole comprising:

(A) an inner sole for engaging the plantar surface, (B) a midsole having an inner surface attached to the exterior of said inner sole to be substantially coextensive with said inner sole, said midsole having an outer surface, and (C) an outer sole attached to the outer surface of said midsole whereby said midsole is intermediate the inner and outer soles, said outer sole having a first portion extending from the toe portion of the shoe to a position underlying the calcaneum with increasing thickness thereby to underlie at least a portion of the forefoot and a second, contiguous portion extending from said first portion to said rear portion for underlying the heel, said first portion providing a landing surface for the shoe and said second portion being relatively thin as compared to said first portion whereby an exterior surface of said second portion is recessed relative to the landing surface thereby to inhibit landings on the heel.

2. A shoe as recited in claim 1 wherein the calcaneum of the individual's foot includes an apex and wherein said outer sole is comprised of a compressible hard rubber material, said outer sole extending from the toe portion to the apex of the calcaneum.

3. A shoe as recited in claim 1 wherein the individual's foot includes distal phalanges of the toes with a base and the calcaneum with a base and wherein said midsole is comprised of a hard, pressure-deformable, cellular material that extends from the base of the calcaneum to the base of the distal phalanges of the toes.

4. A shoe as recited in claim 1 wherein the individual's foot includes the calcaneum with an apex and base, distal phalanges having a base and tarsometatarsal joints and wherein said outer sole is comprised of a compressible hard rubber material, wherein first portion of said outer sole extends from the toe portion of the shoe to the apex of the calcaneum with generally increasing thickness and said second portion of said outer sole extends from the base of the calcaneum to the rear portion of the shoe and wherein said midsole is comprised of a hard, pressure-deformable, cellular material that extends from the apex of the calcaneum to the base of the distal phalanges of the toes, said shoe having a center of gravity at the tarsometatarsal joints.

5. A shoe as recited in claim 1 wherein the upper and said multiple part sole define a heel box generally coextensive with said second outer sole portion for receiving the heel and a toe box generally coextensive with said first outer sole portion for receiving the remainder of the foot including the toes, said toe box being wider than said heel box.

6. A shoe as recited in claim 1 wherein said exterior surface of said first outer sole portion includes spaced recesses and extensions distributed across the exterior surface.

7. A shoe as recited in claim 6 wherein said shoe is formed along a longitudinal axis from the toe portion to the rear portion of said shoe and said recesses include longitudinally spaced, transverse channels across the face of said landing surface.

8. A shoe as recited in claim 7 wherein said shoe is adapted for use with a cord for training and wherein said first outer sole portion includes means at one of said channels for engaging the cord.

9. A shoe as recited in claim 6 wherein said extensions include a plurality of spaced polygonal extensions distributed about the periphery of said first outer sole portion and a plurality of spaced hemispherical extensions distributed about the interior portion of said first outer sole portion.

10. A shoe as recited in claim 1 wherein the individual's foot includes a fifth metatarsal bone and wherein said outer sole has a lateral extension for underlying the fifth metatarsal bone.

11. A shoe as recited in claim 1 wherein the individual's foot is characterized by a skeletal structure and wherein said inner sole is composed of a relatively thin resilient layer of material and at least one of said midsole and outer sole includes a support for the underlying the skeletal structure of the foot.

12. A shoe as recited in claim 11 wherein said first outer sole portion forms an inner surface that is convex toward the interior of the shoe in longitudinal and transverse planes.

13. A shoe as recited in claim 11 wherein said midsole includes a central contoured portion to underlie, support and position the arch of the foot.

14. A shoe as recited in claim 13 wherein the individual's foot is characterized by including metatarsal heads and wherein said midsole includes a plurality of annular members for supporting and positioning certain of the metatarsal heads of the foot.

15. A shoe as recited in claim 11 wherein the skeletal structure includes the calcaneum and wherein said second outer sole portion includes an upper surface with an annular member for alignment with the calcaneum.

16. A shoe having an upper for covering at least a portion of a foot and a multiple part, laminated sole attached to said upper for forming an interior volume extending from a toe portion to a heel portion for receiving a individual's foot characterized by including toes, a heel, a plantar surface, distal phalanges of the toes, a calcaneum with a base and apex and a forefoot, said sole comprising:

(A) inner sole means for engaging the plantar surface of the foot, (B) midsole, means for providing a shock absorbing cushion, said midsole means extending from the base of the distal phalanges of the toes to an area corresponding to the base of the calcaneum, the thickness of said midsole means varying to a maximum thickness proximate the calcaneum, and (C) outer sole means for defining exterior lower surfaces of the shoe, said midsole means being intermediate said inner and outer sole means and said outer sole means including:

(i) landing surface means for forming a landing surface extending from the apex of the calcaneum to the base of the distal phalanges of the toes, and (ii) recessed surface means for forming a surface that is recessed relative to said landing surface means and that extends oppositely to said landing surface means from the apex of the calcaneum to the rear portion of the shoe whereby, in use, said landing surface means engages the ground and said recessed surface means remains spaced from the ground and landing forces are transmitted through said landing surface means of said outer sole means, said midsole means and said inner sole means to the forefoot.

17. A shoe as recited in claim 16 wherein said outer sole means defines first and second inner surface portions substantially coextensive with said landing and recessed means, respectively, said first inner surface contacting said midsole means and said second inner surface having portions contacting said midsole means and portions contacting said inner sole means, said inner sole means comprising a relatively thin, resilient layer conforming to the plantar surface.

18. A shoe as recited in claim 17 wherein said midsole means defines another upper surface and at least one of said upper surfaces includes means for conforming said inner sole means to the plantar surface thereby to support and position the underlying skeletal structure of the foot.

19. A shoe as recited in claim 18 wherein one of said upper surfaces includes means for positioning and supporting the toes.

20. A shoe as recited in claim 19 wherein one of said upper surfaces includes an annular ring means positioned to underlie the heel opposite the base of the calcaneum for supporting and positioning the heel.

21. A shoe as recited in claim 20 wherein one of said upper surfaces includes a longitudinally extending raised portion corresponding to an arch of the foot.

22. A shoe as recited in claim 21 wherein the individual's foot includes metatarsal heads and wherein one of said upper surfaces includes a plurality of annular extensions for positioning and supporting the metatarsal heads.

23. A shoe as recited in claim 22 wherein one of said upper surfaces includes an annular ring means positioned to underlie the heel opposite the base of the calcaneum for supporting and positioning the heel.

24. A shoe as recited in claim 23 wherein the individual's foot is characterized by an arch and wherein one of said upper surfaces includes a longitudinally extending raised portion corresponding to an arch.

25. A shoe as recited in claim 24 wherein one of said upper surfaces includes a plurality of annular extensions for positioning and supporting the metatarsal heads of the foot.

26. A shoe as recited in claim 18 wherein one of said upper surfaces includes a plurality of annular extensions for positioning and supporting the metatarsal heads of the foot.

27. A shoe as recited in claim 18 wherein said recessed surface means is composed of a relatively hard substantially rigid material.

28. A shoe as recited in claim 27 wherein said landing surface means is composed of a pressure deformable material to cushion the foot on contact between said landing surface means and the ground.

29. A shoe as recited in claim 27 wherein said midsole means is composed of a hard, pressure-deformable cellular material.

30. A shoe as recited in claim 18 wherein said landing surface means is composed of a pressure deformable material to cushion the foot on contact between said landing surface and the ground.

31. A shoe as recited in claim 18 wherein said midsole is composed of a hard, pressure-deformable cellular material.

32. A shoe as recited in claim 18 wherein said landing surface means includes spaced recesses and extensions distributed across the landing surface.

33. A shoe as recited in claim 32 wherein said shoe is formed along a longitudinal axis from a toe portion to a rear portion of said shoe and said recesses include longitudinally spaced, transverse channels across the face of the landing surface.

34. A shoe as recited in claim 33 wherein the individual's foot is characterized by including a styloid process of the fifth metatarsal bone and wherein said landing surface has a lateral extension for the styloid process of the fifth metatarsal bone.

35. A shoe as recited in claim 33 wherein said shoe is adapted for use with a cord for training and wherein outer sole means includes means at said channels for engaging the cord.

36. A shoe as recited in claim 32 wherein said extensions include a plurality of spaced polygonal extensions distributed about the periphery of said landing surface means and a plurality of spaced hemispherical extensions distributed about the interior portion of said landing surface means.

* * * * *